US005285978A

United States Patent [19]

Sakano et al.

[11] Patent Number: 5,285,978

[45] Date of Patent: Feb. 15, 1994

[54] DEVICE FOR CHANGING WEB ROLLS AUTOMATICALLY

[75] Inventors: Makoto Sakano; Shozo Horikawa; Shuji Wada, all of Tokyo, Japan

[73] Assignee: Japan Tobacco Inc., Tokyo, Japan

[21] Appl. No.: 969,441

[22] Filed: Oct. 30, 1992

[30] Foreign Application Priority Data

Oct. 31, 1991 [JP] Japan ..... 3-311388

[51] Int. Cl.[5] ..... B65H 19/12; B65H 19/18

[52] U.S. Cl. ..... 242/58.1; 242/58.5; 242/64

[58] Field of Search ..... 242/58, 58.1, 58.2, 242/58.3, 58.4, 58.5, 58.6, 64, 56 A, 59 R, 79

[56] References Cited

U.S. PATENT DOCUMENTS

| | | | |
|---|---|---|---|
| 3,257,085 | 6/1966 | Riegger | 242/58.3 |
| 4,415,127 | 11/1983 | Seragnoli | 242/58.1 |
| 4,564,149 | 1/1986 | Barzavo | 242/58.1 |
| 4,597,316 | 7/1986 | Ichikawa | 242/58 |
| 4,646,986 | 3/1987 | Heitmann | 242/58.1 |
| 5,152,472 | 10/1992 | Spang et al. | 242/584 X |

FOREIGN PATENT DOCUMENTS

| | | |
|---|---|---|
| 0155863 | 9/1985 | European Pat. Off. . |
| 4040545 | 6/1991 | Fed. Rep. of Germany . |
| 2167047 | 5/1986 | United Kingdom . |

*Primary Examiner*—Daniel P. Stodola
*Assistant Examiner*—John P. Darling

[57] ABSTRACT

An automatic web roll changing device is adapted to automatically and continuously supply web rolls to a web supply-connection apparatus on which are replaceably mounted two web rolls from which webs are alternately and continuously drawn out and which connects the trailing end portion of the preceding web to the leading end portion of the following web. This device includes a rotary arm pivoted to the web supply-connection apparatus having, at both ends, hubs carrying the above-mentioned two web rolls, and a web roll storage-mounting unit provided opposite to the web supply-connection apparatus. The web supply-connection apparatus has a rotary head which is rotatable about a vertical axis. From the rotary head horizontally extend a plurality of web roll storing shafts for holding a plurality of web rolls so as to be slidable axially of the shafts. The web rolls on the storing shafts are moved toward the distal ends of the web roll storing shaft by driving units so as to be mounted on the hubs.

3 Claims, 14 Drawing Sheets

DEVICE FOR CHANGING WEB ROLLS AUTOMATICALLY

BACKGROUND OF THE INVENTION

1. Field of the Invention

This invention relates to a device for automatically mounting web rolls, each having a core and a belt-like thin sheet or a web wound therearound, used in an apparatus for taking off the web from each of the web rolls, and more particularly to a web changing device for automatically replacing, with a new web roll, the used web roll mounted in a web supplying apparatus for continuously taking off webs from paper web rolls and supplying the webs to the web changing device. The web supplying apparatus is used in a machine for manufacturing cigarette rods, filter rods and the like, which are intermediate products of cigarettes.

2. Description of the Related Art

In the conventional cigarette manufacturing process, belt-like paper sheets are wound around cigarette material to form elongated cigarette rods, and thereafter the rods are cut into pieces each having a predetermined length. Similarly, when filters are manufactured in the conventional process, belt-like paper sheets are also wound around filter sheets made of fiber or the like to form elongated filter rods and thereafter the filter rods are cut into pieces each having a predetermined length.

Therefore, continuous supply of the above-mentioned belt-like paper pieces, i.e., webs, is required for producing cigarette rods and filter rods. Such a web is usually supplied in a form of the web roll comprising a core and a web wound around a roll, as shown in FIG. 7. The web roll is mounted in a web supplying apparatus and the web is continuously taken off from the web roll and is supplied therefrom to the succeeding apparatus. When the web on the web roll is fully used, a web is taken off from a new web roll and the leading end of the new web is connected to the trailing end of the web from the old web roll. In such a way, webs are supplied continuously.

There has been recently developed a web supplying device which is provided with two web rolls so as to perform these processes automatically. A web is taken off from a first web roll and is supplied to the succeeding apparatus. When the web on the first web roll is fully used, a web is drawn out from the second web roll which was in a waiting state, and the leading end of the web on the second web roll is automatically connected to the trailing end of the web of the first web roll. Thereafter, the core and other necessary parts are removed from the web supplying apparatus, and a new web roll is mounted thereon. With this web supplying device, this series of web supplying and web replacing processes is repeated so that webs are supplied continuously.

Since, however, cigarette manufacturing machines have been operated at a higher speed thereby increasing the amount of webs to be supplied, the web on a web roll is fully used in about ten minutes. In order to replace the used roll with the one new every ten minutes, an operator must be fully engaged in the replacement work of the web rolls.

It is very difficult for the operator to endure such a continuous simple task for a long time, and in addition thereto, the manpower cost increases.

SUMMARY OF THE INVENTION

This invention provides an automatic web roll changing device which can change web rolls automatically in an apparatus for supplying webs continuously, which can store and hold a great, number of web rolls and which allows the webs to be supplied to continuously a long time by automatically changing web rolls without help of the operator.

The device of this invention supplies webs to a web supply-connection apparatus which takes off a web from a web roll and supplies the web, and when the web in the web roll is fully used, takes off the web from a new web roll and automatically connects the both webs from the old and new web rolls thereby supplying the webs continuously. This device has a web storage-mounting unit which stores a plurality of new web rolls and automatically mounts the new web rolls in the web supply-connection apparatus.

A rotary arm is pivoted at its center to the web supply-connection apparatus. Two hubs, on which web rolls are mounted, are provided on both ends of the rotary arm.

The web storage-mounting unit is disposed opposite to the web supply-connection apparatus and comprises a rotary head rotatable about a vertical axis, for slidably holding a plurality of web rolls on web roll storing shafts, in such a way that the web rolls are arranged axially, and a driving mechanism for forwardly moving the web rolls.

One at a time, a web roll storing shaft is coaxially aligned with one of the hubs of the rotary arm of the web supply-connection apparatus. The web supply-connection apparatus takes off and supplies the web from the other web rolls (hereinafter referred to as "the first web roll"). When the web is fully used on the first web roll, the web supply-connection apparatus draws out the web from another web roll (hereinafter referred to as "the second web roll") and automatically connects the leading end of the web on the second web roll to the trailing end of the web of the first web roll. At the same time, the rotary arm is rotated to move the first web roll to the position where the second web roll had been located. The hub, which carries the first web roll from which the roll has been fully used, faces the web roll storing shaft, and a new web roll held by the web roll storing shaft is mounted on this hub. Every time the web on a web roll is fully used, this process is repeated so that the two hubs on both ends of the rotary arm are supplied with web rolls alternately.

The web roll storage-mounting unit is provided with a plurality of web roll storage shafts extending from the rotary head. A great number of web rolls are held and stored on these shafts. Once a great number of web rolls are mounted in the web roll storage-mounting unit, the changing operation can continue automatically for a long time without help of the operator.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

An embodiment of this invention will now be described with reference to the accompanying drawings. The device according to this embodiment is intended to automatically and continuously supply webs to machines for manufacturing cigarette rods, filter rods and the like via a web supply-connection apparatus. This device has a web roll storage-mounting unit for automatically mounting web rolls on the web supply-connection apparatus.

Figure 7:
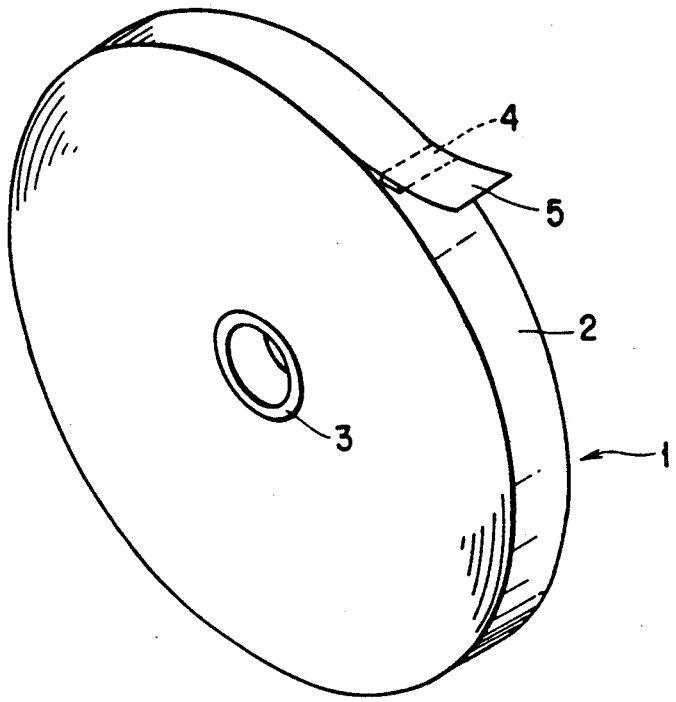
FIG. 7 is a perspective view of a web roll.

A web roll 1 used in the device according to this invention will now be described with reference to FIG. 7. The web roll 1 comprises a core 3 and a web 2 wound therearound. The leading end portion of the web 2 is temporarily attached to the body of the web 2 by an adhesive tape 4 which has such a weak adhering force that the leading end of the web 2 is easily detached from the body of the web 2. The part of the leading end portion of the web 2 between the leading edge thereof and the adhesive tape 4 forms a detaching part 5 having a length of about 4 to 5 mm.

Referring to FIGS. 1 to 4, the overall device according to this invention will now be described. In the figures, a web supply-connection apparatus is designated at 100 and is adapted to continuously take off and supply a web from the respective web roll 1*a* and take off and supply a web from a new web roll 1*b* when the web on the web roll 1*a* is fully used. The apparatus 100 connects the leading end portion of the web on the web roll 1*b* to the trailing end portion of the web which was on the web roll 1*a*. During the supply of the web from the web roll 1*b*, the core 3 of the web roll 1*a* is replaced with a new web roll. The process comprising the supply of the webs, the change of the web rolls, the connection of the webs and the replacement of the web rolls is repeated so that the webs are supplied continuously.

The web 2 is guided by guide rails 301 and supplied from the web supply-connection apparatus 100 to, for example, a cigarette rod manufacturing apparatus 300 having a reservoir box 302 in which a predetermined length of a portion of a web 2 is stored. While the supply of the web from the respective web roll is temporarily stopped in order to connect the corresponding end portions of the webs, the web portion in the reservoir box 302 is supplied.

A web roll storage-mounting unit 200 is disposed opposite to the front face of the web roll supply-connection apparatus 100. The unit 200 stores and holds a great number of web rolls 1 and automatically mounts the web rolls 1 one by one on the web supply-connection apparatus 100 when the web on a web roll is fully used.

A control unit 400 has a control panel and control circuits for controlling the operation of the overall device.

Figure 1:
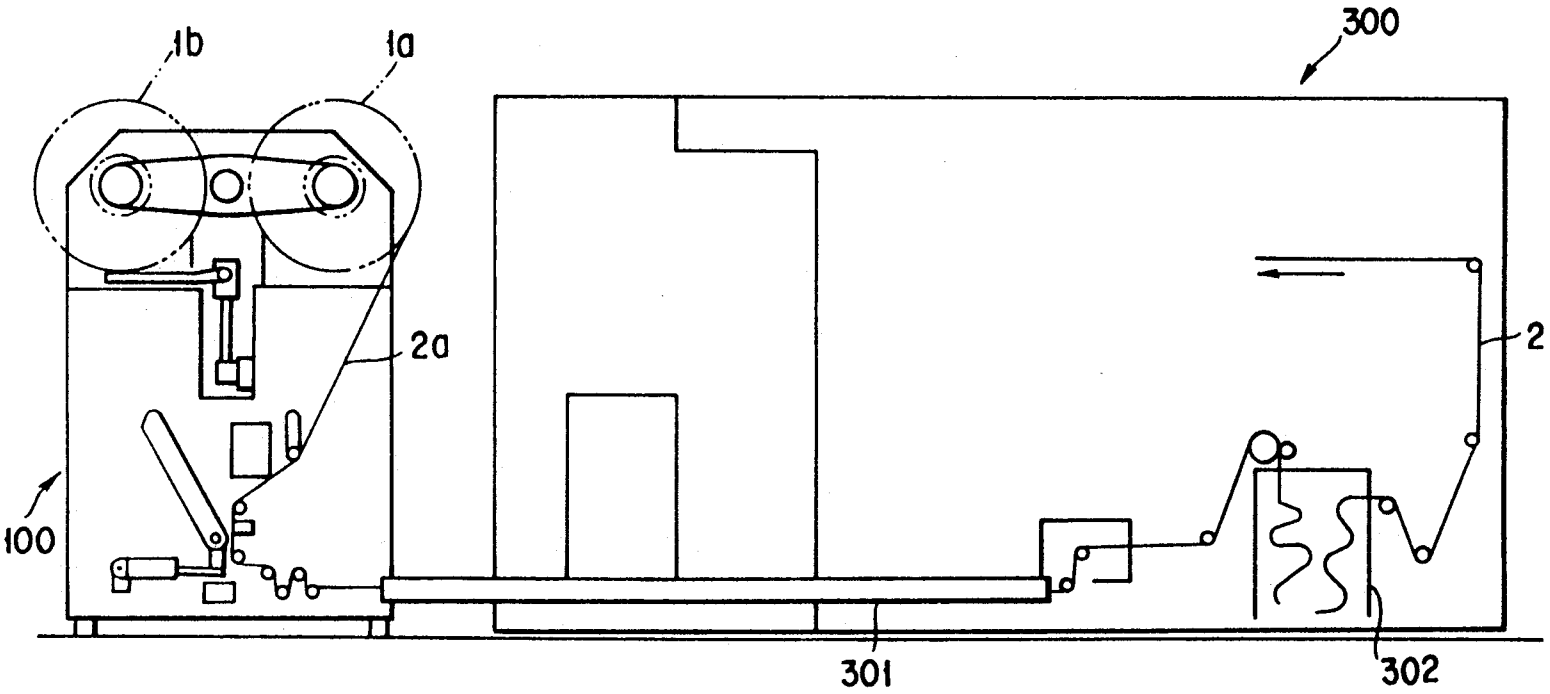
FIG. 1 is a front view of the overall device according to one embodiment of this invention.
Figure 2:
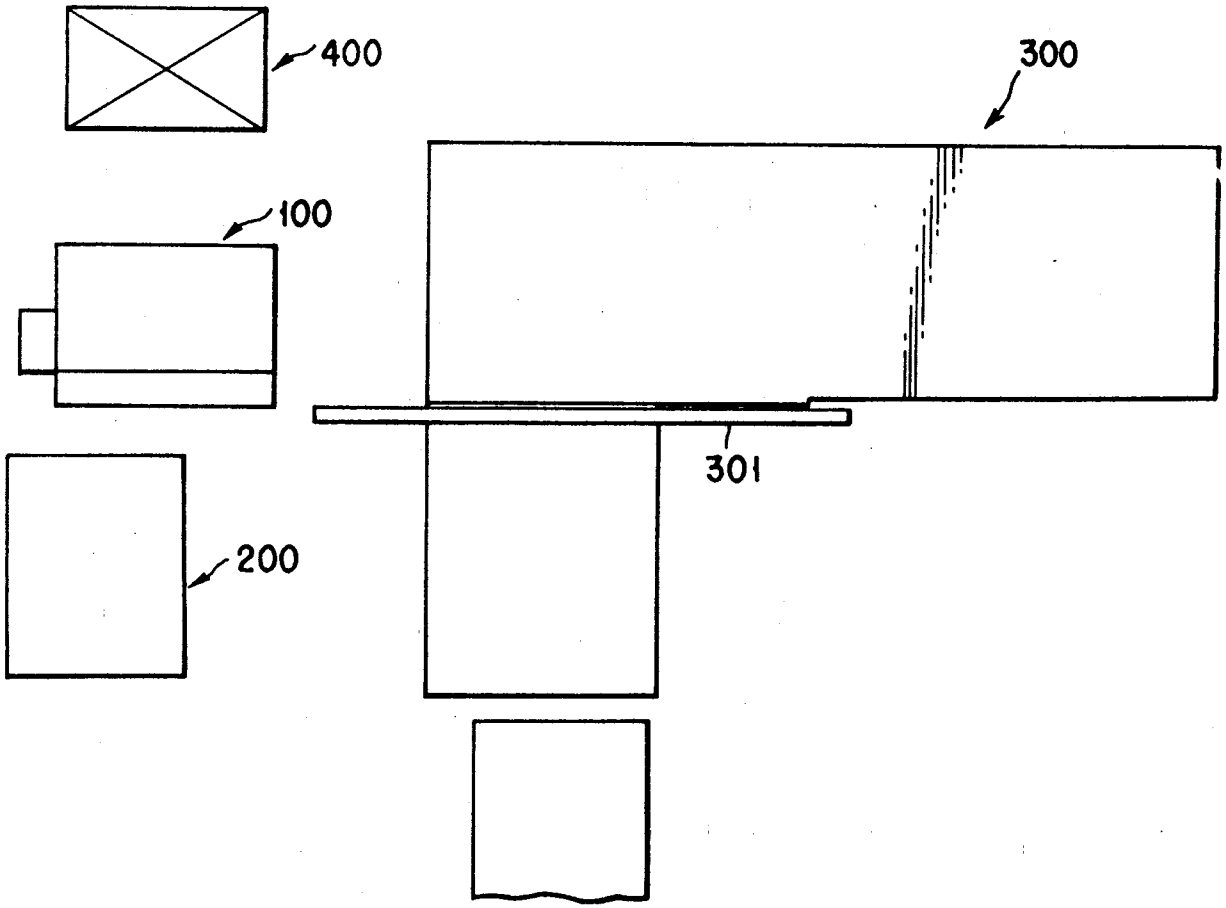
FIG. 2 is a plan view of the overall device according to this embodiment of this invention.
Figure 3:
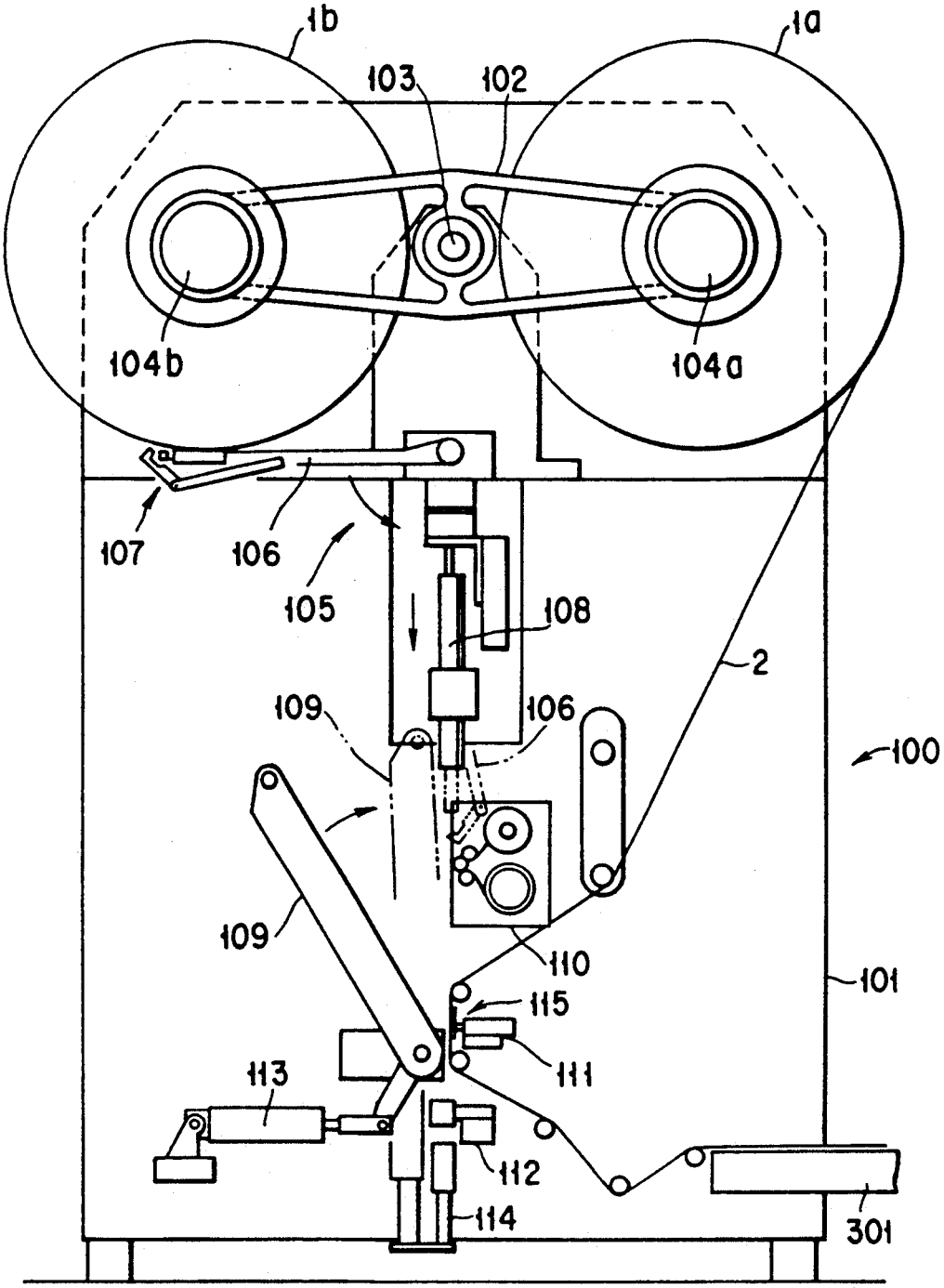
FIG. 3 is a plan view of a web supply-connection apparatus.

The general structure of the web supply-connection apparatus 100 will now be described with reference to FIG. 3. The main body of the apparatus 100 is designated at 101 in the figure. Provided on the upper portion of the front face of the main body 101 is a rotary arm 102 which is rotatable in a horizontal plane about a central rotary shaft 103. On both ends of the rotary arm 102 are provided hubs 104*a* and 104*b* on which web rolls 1 are mounted. In the state of FIG. 3, a web 2*a* is being taken off from a web roll 1*a* mounted on the right-side hub 104*a*, and a web roll 1*b* on which a web is fully wound and which is mounted on the left-side hub 104*b* is in a waiting state.

The web 2 taken off from the right-side web roll 1*a* is guided by a plurality of rollers and supplied to the cigarette manufacturing apparatus 300 through the guide rails.

A drawing-out mechanism 105 is provided under the web rolls and has a drawing-out arm 106 which is rotatable in a vertical plane, moved vertically by a lifting mechanism 108 and also moved back and forth. A chucking mechanism 107 is provided on the front end of the drawing-out arm 106.

After a new web roll 1*b* has been mounted, the front end of the drawing-out arm 106 abuts against the lowest surface portion of this web roll 1*b* which is in the waiting state, and the chucking mechanism 107 catches the detaching part 5 of the web 1*b*. While the drawing-out arm 106 rotates downward to the vertical position, the web 2 is drawn out, and the arm 106 is lowered by the lifting mechanism 108 to the position shown by two-dotted lines in FIG. 3.

A feed mechanism 109 is pivoted at its lower end to the lower portion of the front face of the main body 101 and is rotated by a cylinder 113 in a vertical plane. The feed mechanism 109 has an endless sucking belt which is formed with a great number of holes and whose inner pressure is rendered negative. After having been rotated to the vertical position shown by the two-dot lines in FIG. 3, the feed mechanism 109 sucks the leading end of the web 2 held by the drawing-out arm 106 and receives the web 2. Thereafter, the sucking belt is moved so as to send the leading end of the web downward.

An adhesive tape supplying mechanism 110 is also provided on the front face of the main body 101. An adhesive tape such as a double-stick Type adhesive tape is attached by the adhesive tape supplying mechanism 110 to the leading end portion of the web which the feed mechanism 109 is sucking.

The web to which the adhesive tape has been attached is further moved downward by the feed mechanism 109 and overlaps with the vertically running portion of the web roll 1 which has already been taken off. Then, the previously taken-off web stops and is pressed by a pushing mechanism 111 against the leading end portion of the web which is being taken off so that both webs are connected by the adhesive tape.

A cutting mechanism 112 and a chucking mechanism 114 are provided on the lower portion of the main body 101. After the leading end portion of the web, which is being drawn out, has been held and provided with a predetermined tension by the chucking mechanism 114, this web is cut at the portion just ahead of the adhesive tape by the cutting mechanism 112 and the excess portion of the leading end portion of this web is removed.

The portion of the previously drawn-out web which is the just rear portion of the adhesive tape is also cut by a cutter provided on the pushing mechanism 111. In this connection, the leading end portion of the web which is being drawn out from the web roll 1*b* and the tailing end portion of the already drawn-out web are connected by the adhesive tape.

The rotary arm 102 rotates through 180° and the web roll 1*b* from which the web is being taken off is moved to the right side. The core of the web roll 1*a* from which the web has been taken off is removed from the hub 104*a* and the hub 104*a* from which the core has been removed (hereinafter referred to as "the free hub") is moved leftward.

After this, a new web roll is mounted on the free hub 104*a* from the web roll storage-mounting unit 200.

Figure 4:
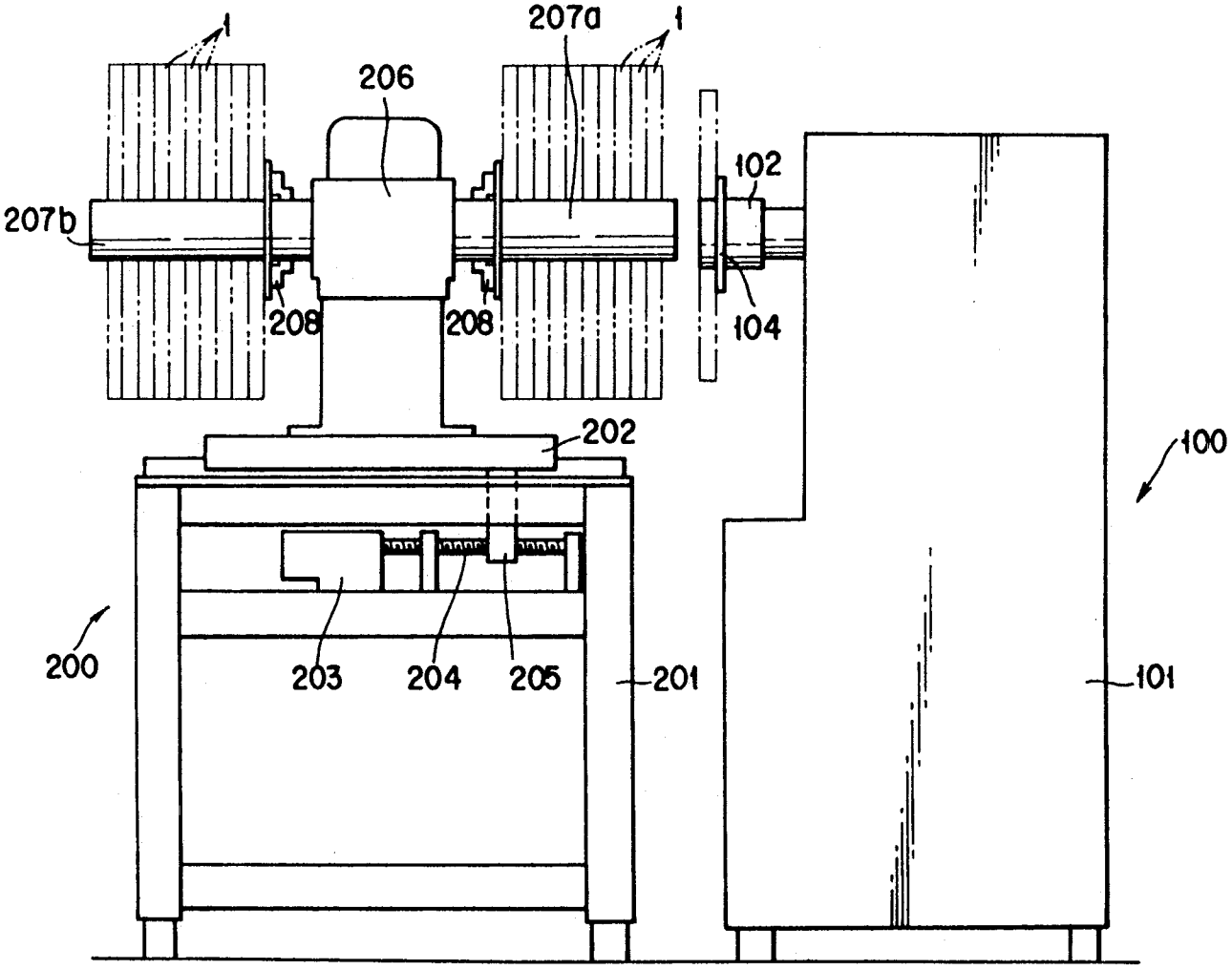
FIG. 4 is a side view of a web roll storage-mounting unit.

The general structure of the web storage-mounting unit 200 will now be described with reference to FIG. 4. The unit 200 has a main body 201 which is provided with a moving table 202 movable toward and away from the web supply-connection apparatus 100. A nut member 205 is provided on the moving table 202 and engages a screw shaft 204 rotated by a motor 203 in a normal direction and in the opposite direction thereto.

A rotary head 206 is provided on the moving table 202 so as to rotate about a vertical axis. A plurality of web roll storing shafts 207 extend horizontally from the rotary head 206 so that they are separated by the same angle from one after another. In the case of FIG. 4, two web roll storing, shafts 207*a* and 207*b* extend from the rotary head 206 in the opposite directions so that they are separated by 180° from each other. A great number of web rolls 1 are axially slidably mounted on the web roll storing shafts 207*a* and 207*b*. Each web roll storing shaft has a pushing-out mechanism 208. The mechanism 208 moves axially of the respective web roll storing shaft and moves the web rolls 1 held on the web roll shaft to push them out one by one from the front end of the shaft.

When either one of the web roll storing shaft 207*a* and 207*b* faces the web supply-connection apparatus 100, it is axially aligned with the left-side hub 104*b*. After the webs have been connected together and the free hub (i.e., the hub from which the core was removed) has been moved leftward by the rotary arm 102, the moving table 202 of the web roll storage-connection unit 200 is moved together with the rotary head 206 and the web roll storing shafts 207*a* and 207*b* until the front end of the web roll storing shaft 207*a* abuts against the front end of the free hub. In this condition, the pushing-out mechanism 208 pushes out a web roll 1 held by the web roll storing shaft facing the web supply-connection apparatus 100 and then mount- the same on the free hub.

This process is repeated in such a way that, when the roll on the operating web roll is going to be fully used, a new web is drawn from the web roll which was in a waiting state so that the leading end portion of the new web is connected to the trailing end portion of the previously drawn-out web, whereby the webs are continuously supplied and a new web roll is mounted on the free hub.

Figure 5:
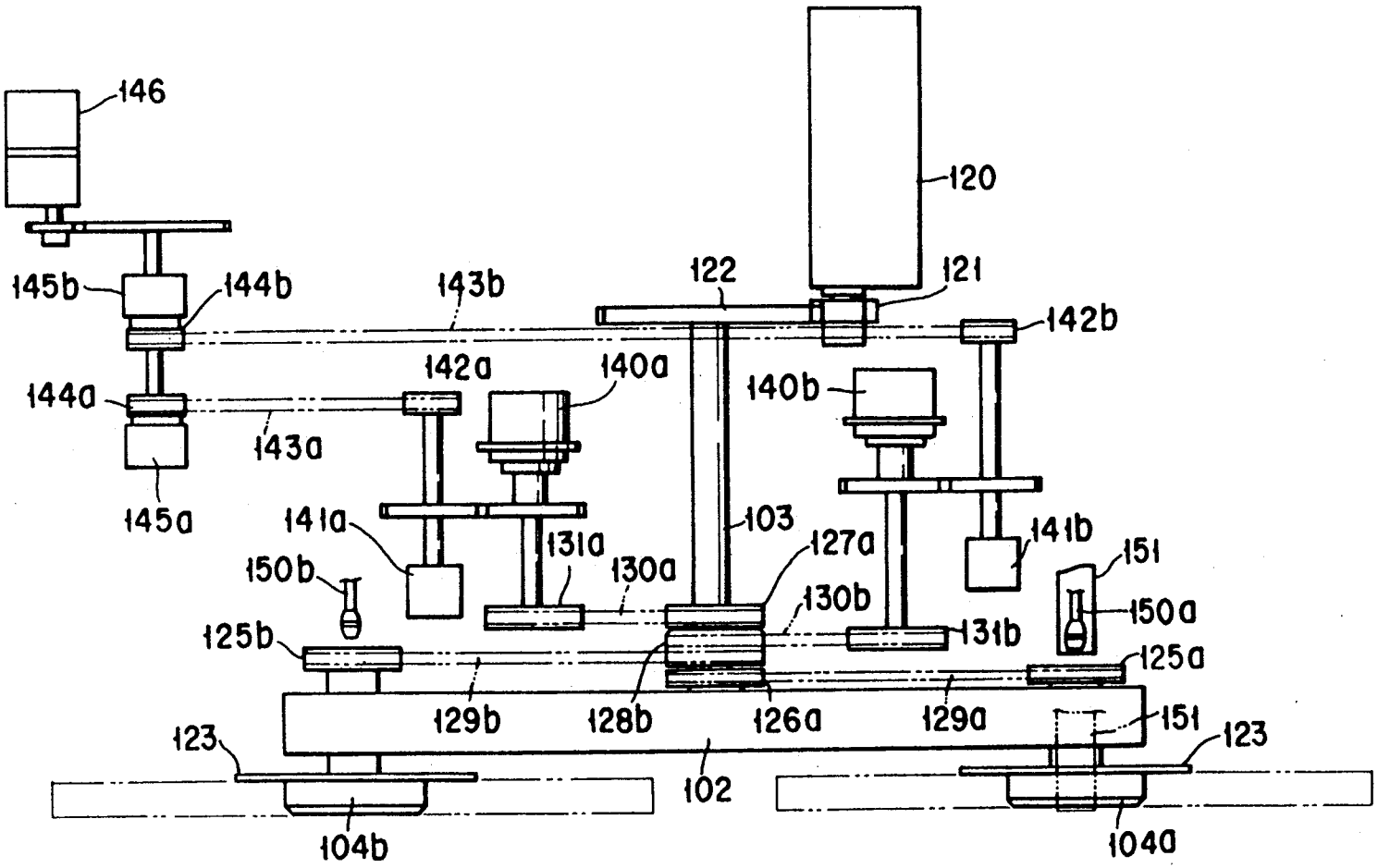
FIG. 5 is a general plan view of the driving system of a rotary arm and hubs.

The driving mechanism of the rotary arm 102 and the hubs 104*a* and 104*b* will now be described with reference to FIG. 5. The rotary shaft 103, to which the central portion of the rotary arm 102 is pivoted, is rotated by a motor 120 through gears 121 and 122. Each of the hubs 104*a* and 104*b* is provided with a flange portion 123.

The hub 104*a* is connected to a power brake 140*a* and a rotary encoder 141*a* through a pulley 125*a*, pulleys 126*a* and 127*a* rotatable together about the rotary shaft 103, a pulley 131*a* and belts 129*a* and 130*a*. The hub 104*b* is connected to a power brake 140*b* and a rotary encoder 141*b* through a pulley 125*b*, a pulley 128*b* rotatable with respect to the rotary shaft 103 and the pulleys 126*a* and 127*a*, a pulley 131*b* and belts 129*b* and 130*b*. As the web is taken out from a web roll on the operating hub, the web is provided with predetermined resistance, i.e., a predetermined tension. The number of rotations, the taken-out length of the web and the like are detected by the respective encoder.

The power brakes 140*a* and 140*b* and the rotary encoders 141*a* and 141*b* are connected to a motor 146 through a connection mechanisms comprising pulleys 142*a* and 142*b*, belts 143*a* and 143*b*, pulleys 144*a* and 144*b*, belts 143*a* and 143*b*, pulleys 144*a* and 144*b* and clutches 145*a* and 145*b*. The hubs 104*a* and 104*b* are rotated in a normal direction and in the opposite direction, respectively, by the motor 146 through the connection mechanism.

Provided with each of the hubs 104*a* and 104*b* is a chucking mechanism (not shown) operated under pneumatic pressure. An air passage is formed in the shaft portion of each of the hubs 104*a* and 104*b*. Reciprocating air pressure connectors 150*a* and 150*b* are provided behind the shafts of the hubs 104*a* and 104*b*. As the connectors advance and are connected to the air passages of the hubs 104*a* and 104*b*, pneumatic pressure is supplied to the chucking mechanisms of the hubs 104*a* and 104*b*.

Behind the right-side hub 104*a* is provided a core rejecting member 151 which is movable back and forth. As the core rejecting member 151 advances, it passes through a hole formed in the flange portion 123 and pushes the free core (i.e., the core from which the web is drawn out) on the right-side hub 104*a* to reject the same.

Figure 6:
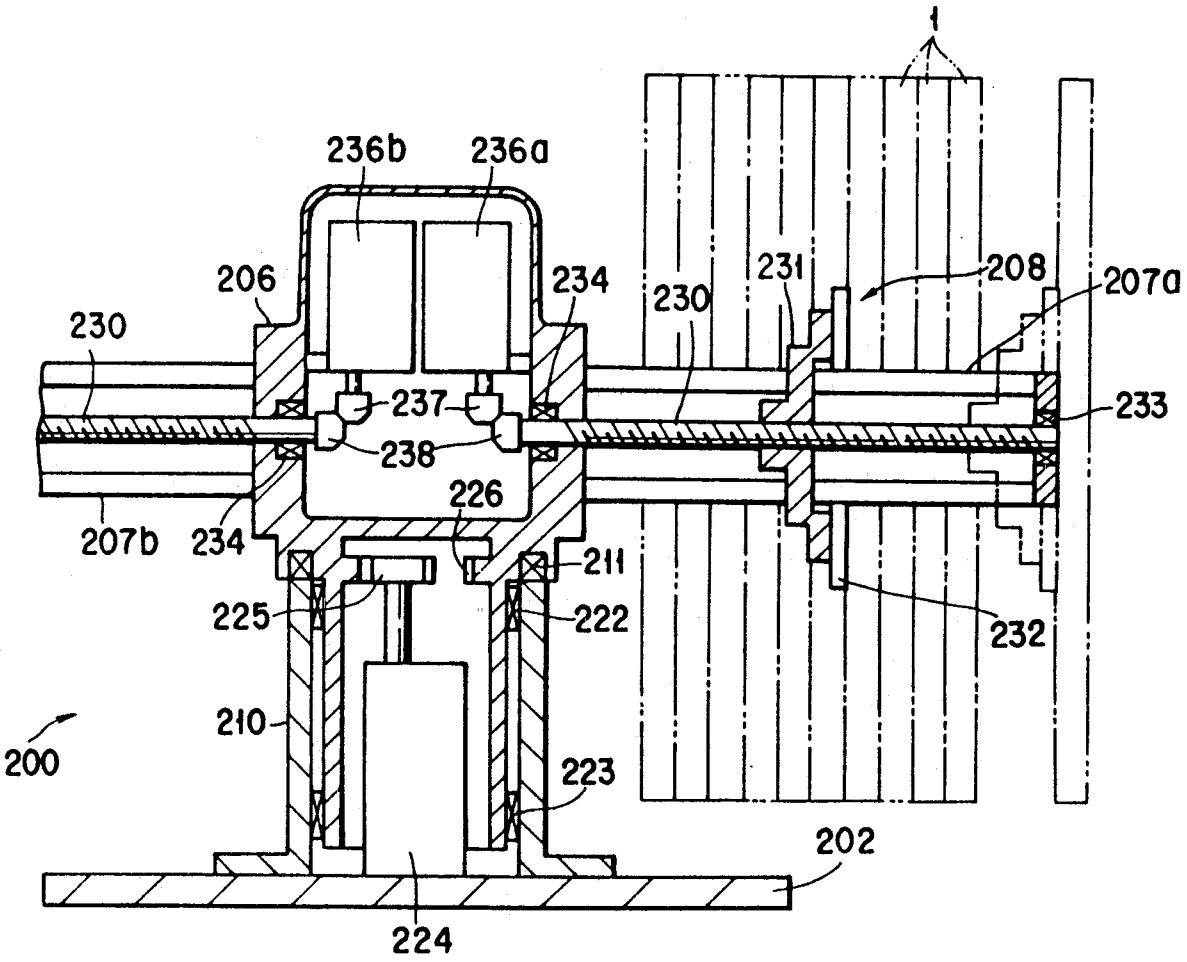
FIG. 6 is a longitudinal cross-sectional view of the main part of the web roll storage-mounting unit.

As shown in FIG. 6, the web roll storage-mounting unit 200 has the moving table 202 and a cylindrical supporting member 210 projecting upward therefrom. The rotary head 206 is rotatably supported on the supporting member 210 by bearings 211, 222 and 223. In the rotary head 206 is formed an internal gear 226 which meshes with an external gear 225 driven by a motor 224. The rotary head 206 is rotated about a vertical axis by the motor 224.

The pushing-out mechanism 208 comprises the hollow web roll storing shafts 207*a* and 207*b* and screw shafts 230 coaxially extending through the shafts 207*a* and 207*b* and rotatably supported by bearings 233 and 234, respectively. The shaft screw 230 is rotated by motors 236*a* and 236*b* through bevel gears 237 and 238, respectively.

Engaged with the screw shafts 230 are nut members 231 which extend out of the web roll storing shafts 207*a* and 207*b* through axial slits formed therein. A flange member 232 is fixed to each nut member 231.

As the screw shafts 230 are rotated by the motors 236*a* and 236*b*, the nut members 231 and the flange members 232 are moved axially to push out the web rolls 1.

Figure 8:
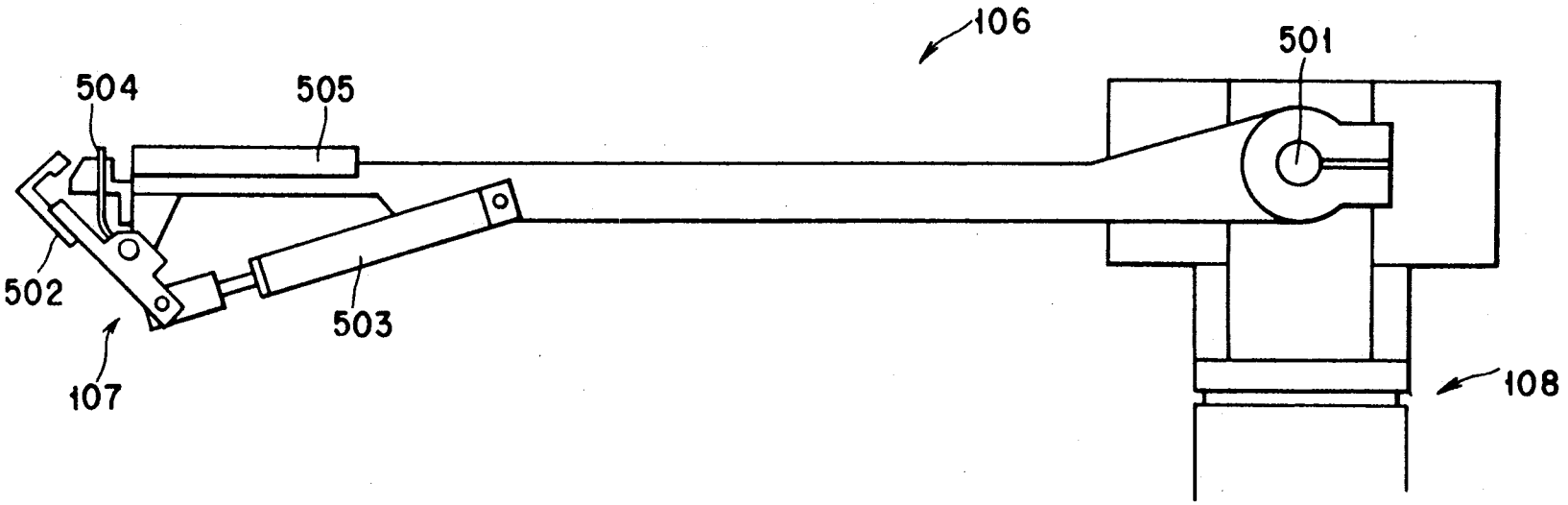
FIG. 8 is a front view of a drawing-out arm.

As shown in FIG. 8, the proximal end portion of the pulling-out arm 106 is rotatably mounted on a shaft 501 so that the pulling-out shaft 106 is rotated about the shaft 501 in a vertical plane.

The chucking mechanism 107 is provided on the distal end portion of the drawing-out arm 107. The chucking mechanism 107 comprises a chucking member 502 and a cylinder 503 for opening and closing it. A hollow sucking mechanism 505 having a great number of holes formed in its upper surface is provided on the upper surface of the distal end portion of the drawing-out arm 106. The interior of the sucking mechanism 505 is connected to a negative-pressure generating mechanism (not shown) for rendering the pressure in the interior of the mechanism 505 negative.

A leading end portion detector 504 is provided on the distal end portion of the drawing-out arm 106. The leading end portion detector 504 is, for example, an optical detector including optical fiber, or the like and is used for detecting the front edge of detaching part 5 of the web of the web roll 1.

When the leading end portion of the web is to be drawn out from the web roll 1*b*, the drawing-out arm 106 is rotated until it takes a vertical position so that a sucking mechanism 505 provided on its distal end portion abuts against the lowest surface portion of the web roll 1. Since the pressure in the sucking mechanism 505 is negative in this condition, air is introduced from the outer atmosphere into the mechanism 505, whereby the portion of the web which is the outer periphery of the web roll is sucked by the mechanism 505. Then, the web roll is rotated in the direction opposite to the direction in which the web is wound on the core. When the front edge of the detaching part 5 of the web arrives at the chucking mechanism, the leading end portion detector 504 detects the front edge. The chucking member 502 of the chucking mechanism 107 is driven by the cylinder 503 so as to hold the detaching part 5 of the web.

The drawing-out arm 106 holding the leading end portion of the web is rotated downward until it takes a substantially vertical downward position and the overall drawing-out arm 106 is lowered by the lifting mechanism 108, whereby the web held by the drawing-out arm 106 is pulled out. Since the adhering force of the adhesive tape 4 is weak, the tape 4 is easily detached and the web is not damaged.

The structure of the feed mechanism 109 will now be described with reference to FIG. 9. The feed mechanism 109 comprises an elongated hollow main body 510 and pulleys 511 and 512 provided on the upper and lower ends, respectively. An endless suction belt 513 is wound on the pulleys 511 and 512. The suction belt 513 is formed with a great number of holes so as to provide air-permeability or porosity. The suction belt may be made of air-permeable material such as fiber. At the left side of the main body 510, the suction belt 513 is exposed to the outer atmosphere. Air tightness is maintained between both sides of the suction belt 513 and the main body 510. The interior of the main body 510 is connected to a negative-pressure generating mechanism (not shown) through a plurality of negative-pressure introducing ports 514 so that the pressure in the main body 510 is maintained negative.

A holding plate mechanism 520 is fixed to the upper portion of the main body 510 of the feed mechanism 109 and is provided with a holding plate 521 having a smooth surface and connected to an actuator 523 through a spring 522. The actuator 523 is fixed to the main body 510 by a fixing plate 524 provided on the front side of the actuator 523.

Figure 9:
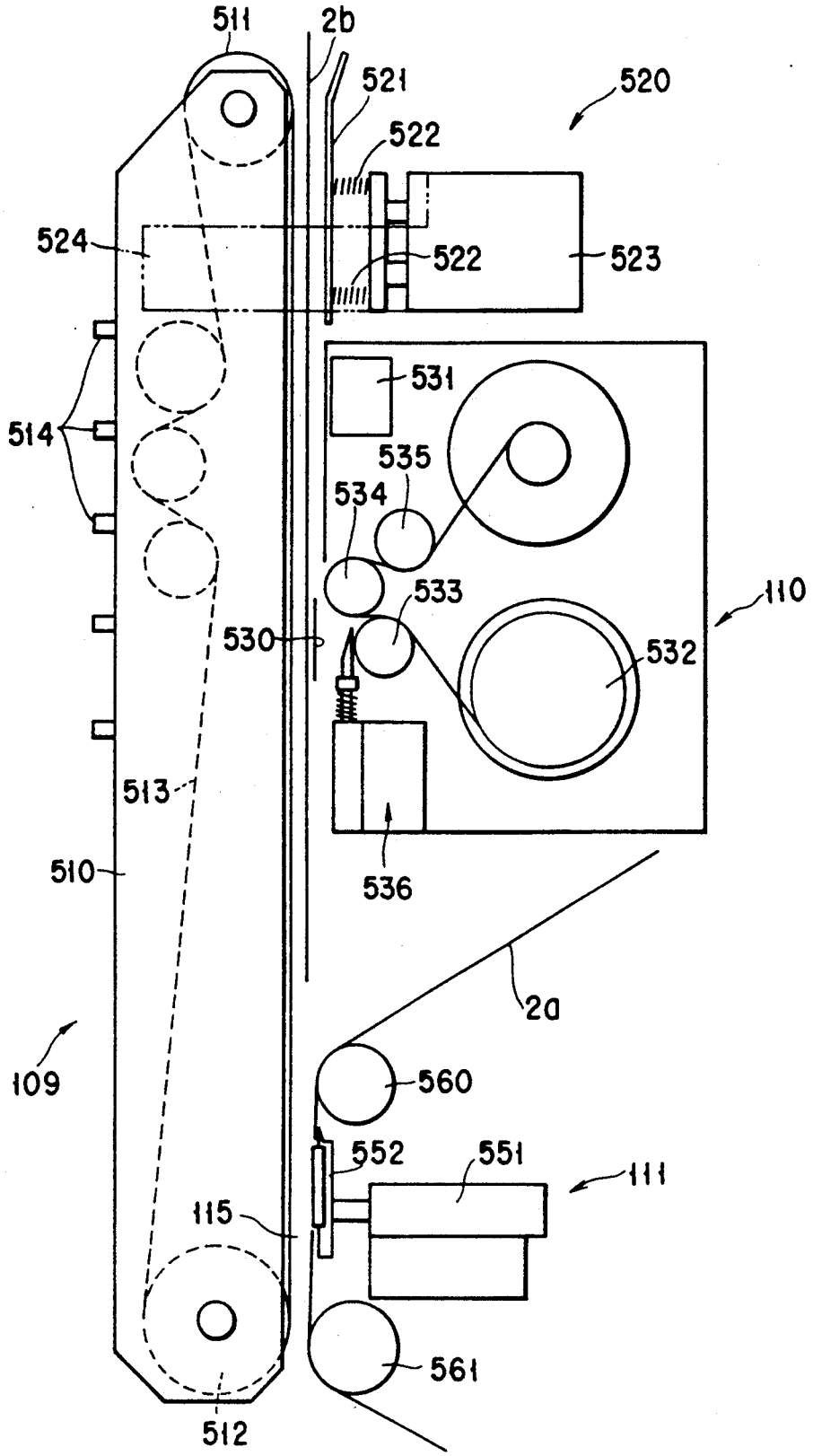
FIG. 9 is a front view showing the portions of a feed mechanism and an adhesive tape supplying mechanism.

When the drawing-out arm 106 holds the leading end portion of the web 2*b* of the new web roll 1*b* and is moved to the vertical downward position as shown by the two-dot lines in FIG. 3 by pulling out the web 2*b*, the feed mechanism 109 is moved to the substantially vertical position as shown in FIG. 9, and the suction belt 513 on the upper portion of the feed mechanism 109 abuts against the leading end portion of the web 2*b*. The negative pressure in the main body 510 of the feed mechanism 106 and the porosity of the suction belt 513 allows the suction belt 513 to suck the leading end portion of the web. Then the drawing-out arm 106 is released and the leading end portion of the web is sucked and accurately held by the suction belt 513. For convenience, the web 2*b* is drawn in a state separated from the suction belt 513 in FIG. 9, but the web 2*b* closely contacts the suction belt 513 in the real condition.

At the same time, the holding plate mechanism 520 operates so that the holding plate 521 is moved by the actuator 523 to cause the leading end portion of the web to closely contact the suction belt 513. In doing so, the web 2*b* closely contacts the suction belt 513 and is sucked more strongly.

In this condition, the suction belt 513 runs and the web 2*b* is sent downward in a state in which the web 2*b* is sucked by the suction belt 513.

The adhesive tape supplying mechanism 110 is provided so as to face the intermediate portion of the feed mechanism 109. The mechanism 110 is used to attach the adhesive tape 530 to the leading end portion of the web 2*b*. On the upper portion of the adhesive tape supplying mechanism 110 is provided a leading end portion detector 531 which is, for example, an optical detector for detecting the leading end portion of the web 2*b* when the web passes the detector 531.

Figure 10:
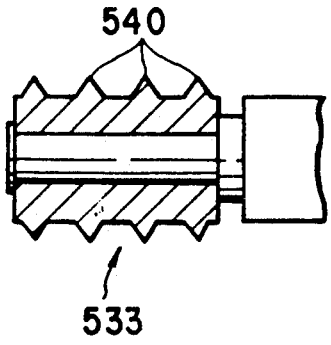
FIG. 10 is a longitudinal cross-sectional view of a roller.
Figure 11:
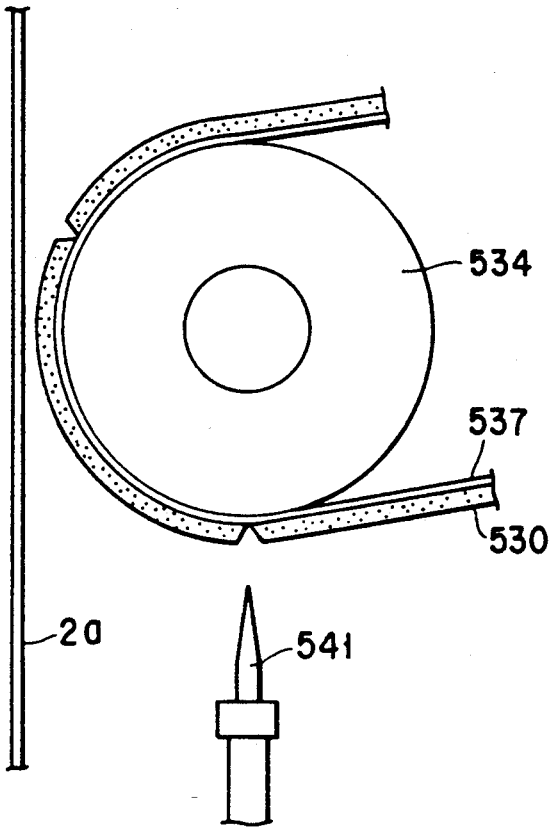
FIG. 11 is a front view of the main part of the adhesive tape supplying mechanism.

As shown in FIGS. 9 to 12, the adhesive tape supplying mechanism 110 includes an adhesive tape reel 532 from which a composite tape comprising a base paper plate 537 and an adhesive tape 530 of both-surface adhering type attached to the plate 532 is supplied as shown in FIG. 11. The composite tape passes on the rollers 533, 534 and 535 and is wound on a tape reel with the adhesive tape 530 disposed outside. As shown in FIG. 10, the roller 533 contacting the adhesive tape 530 is provided with a plurality of ribs 540 each having a sharp outer edge so that the contact area of the ribs 540 with the adhesive tape 530 is made as small as possible to prevent the adhesive tape 530 from being attached to the peripheral surface of the roller 533.

As shown in FIG. 11, only the adhesive tape 530 disposed outside of the composite tape on the roller 534 is cut at predetermined intervals by means of a cutting mechanism 547. A piece of the thus cut adhesive tape 530 adheres to the leading end portion of the lowering web 2b and is separated from the base plate 537. As a result, the adhesive tape piece is attached to the leading end portion of the web 2b.

Figure 12:
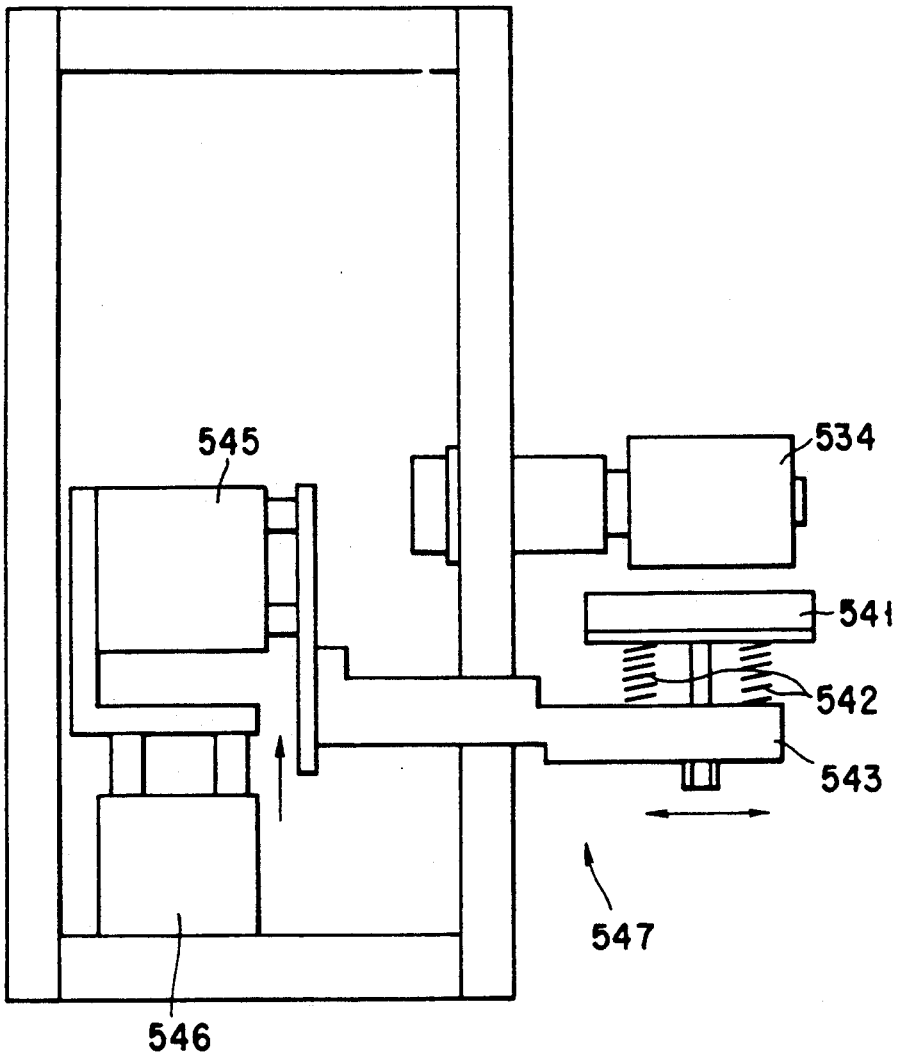
FIG. 12 is a side view of the adhesive tape supplying mechanism.
Figure 13:
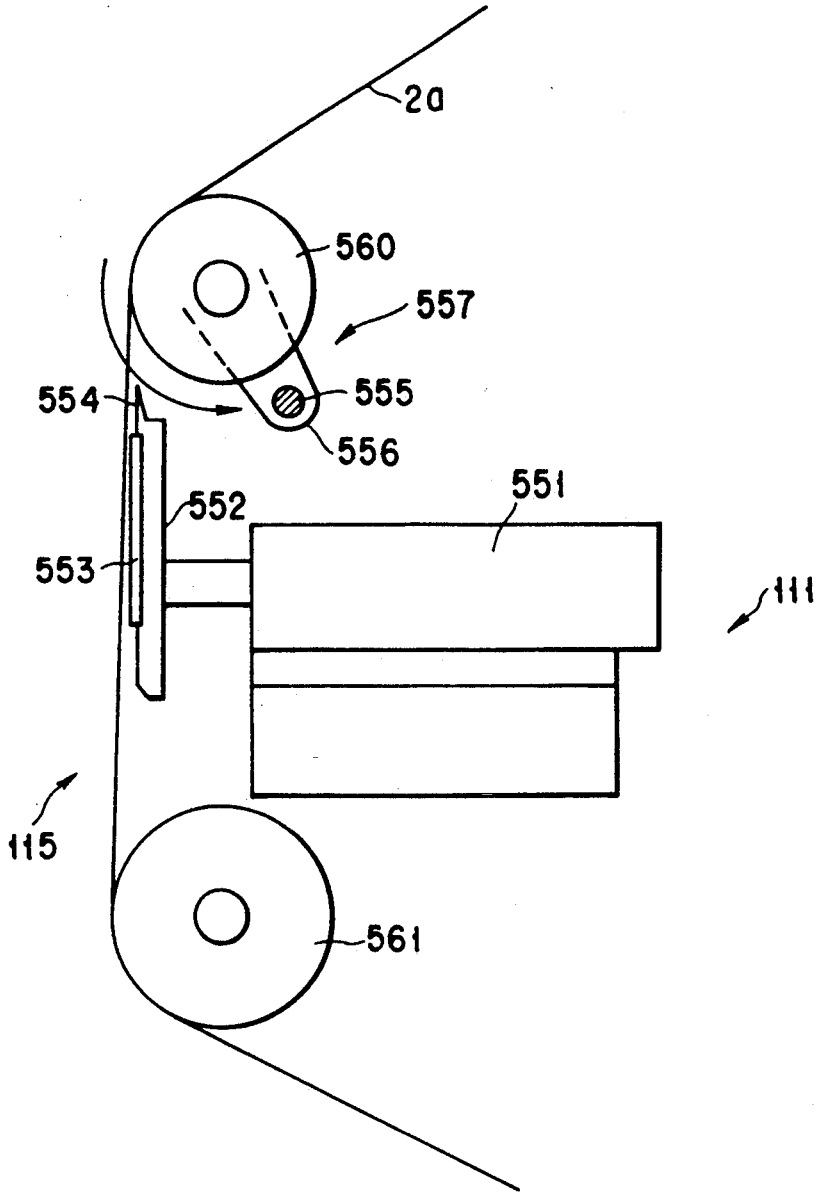
FIG. 13 is a front view of a pressing mechanism.

As shown in FIG. 12, the cutting mechanism 547 has a cutter 541 connected to a moving member 543 through a spring 542. The moving member 543 is fixed to a transverse oscillating actuator 545 and oscillated thereby in the traverse directions of the adhesive tape. The transverse oscillating actuator 545 is fixed to a lift actuator 546 which lifts and lowers the transverse oscillating actuator 545, the moving member 543 and the cutter 541 at the same time.

The cutter 541 is raised by the lift actuator 546 and is in light contact with the adhesive tape 530 by the urging force of the spring 542. Simultaneously, the cutter 541 is oscillated in the transverse directions of the tape by the transverse oscillating actuator 545. In this process, the hard base plate 537 is not cut but only the soft adhesive tape 530 is cut.

Referring to FIGS. 9 and 11, a pressing mechanism 111 is disposed under the adhesive tape supplying mechanism 110. More specifically, the web 2a being taken out is guided by pulleys 560 and 561 and moved vertically in a region between these pulleys. The pressing mechanism 111 is provided in this region and comprises a pressing member 552, a pad 553 made of synthetic rubber or the like and provided on the front face of the pressing member 552, and a cutter 554 formed on the upper end of the pressing member 552. The pressing member 552 is pressed against the web 2a by an actuator 551.

As a web 2b is sent downward by the feed mechanism 109, its leading end portion is detected by the leading end portion detector 531, and then the web 2b stops running after it has been sent by a predetermined length. An adhesive tape 530 is attached to the predetermined part of the leading end portion of the web 2b. Thereafter, the web 2b is sent downward farther and stops again at the position of the pressing member 552. The pressing member 552 is moved forward by the actuator 551 and presses the web 2a against the adhesive tape 530 on the web 2b, whereby the leading end portion of the web 2b which is being drawn out is connected to the trailing end portion of the previously drawn-out web 2b.

The pressing mechanism 111 includes a cutting mechanism 557 for cutting a web 2a which is being drawn out. The cutting mechanism 557 has a cutting rod 555 which passes the region close to the cutter 541 on the upper end of the pressing member 552 by means of a driving mechanism including an arm 556. The web 2a is caught, pressed against the cutter 554 and cut by the moving cutting rod 555. It is preferred that the cutter 554 take the form of saw teeth in order to cut the web easily.

Figure 14:
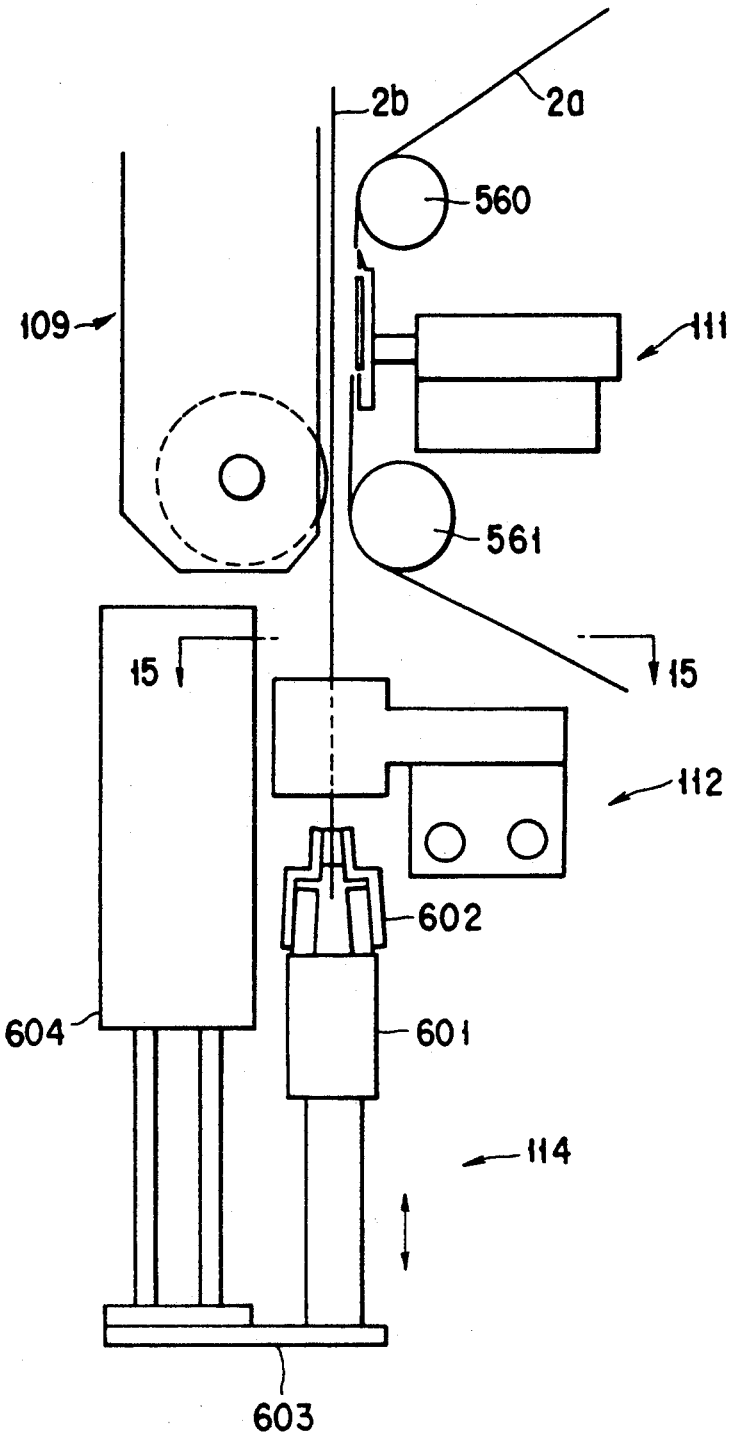
FIG. 14 is a front view of the portions of a cutting mechanism and a chucking mechanism.
Figure 15:
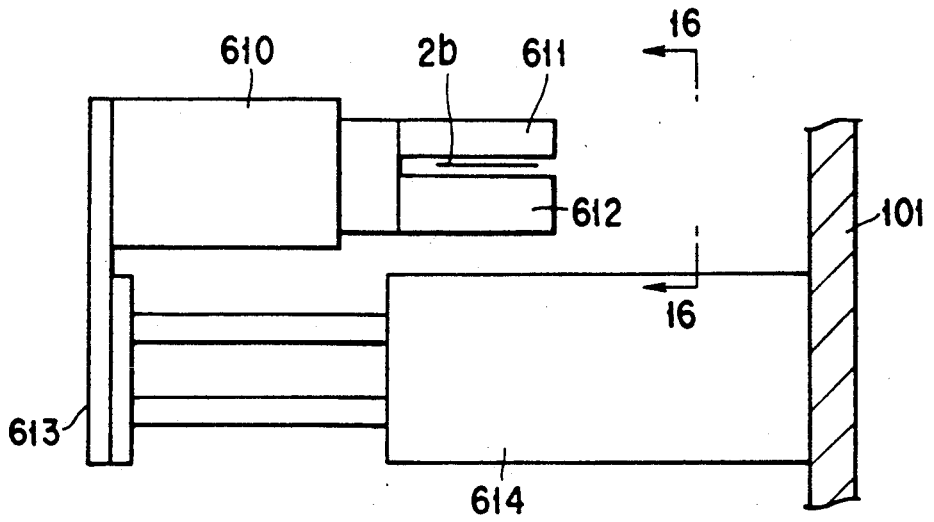
FIG. 15 is a cross-sectional view taken along line 15—15 of FIG. 14.

Referring to FIGS. 14 and 15, a cutting mechanism 112 and a chucking mechanism 114 for cutting the portion of the newly supplied web 2b between the adhesive tape 530 and the leading end edge of the web 2b, i.e., an excess portion of the leading end portion of the web 2b such as the adhesive tape 4 and the detaching part 5, are provided under the pressing mechanism 111.

As shown in FIG. 14, the chucking mechanism 114 has a pair of chucks 602 and an actuator 601 which opens and closes the chucks 602. The actuator 601 is connected to a lift cylinder 604 by a moving member 603 and moves the cylinder 604 upward and downward. The chucks 602 hold the leading end portion of the lowered web 2b and are lowered to give predetermined tension to the web 2b.

Figure 16:
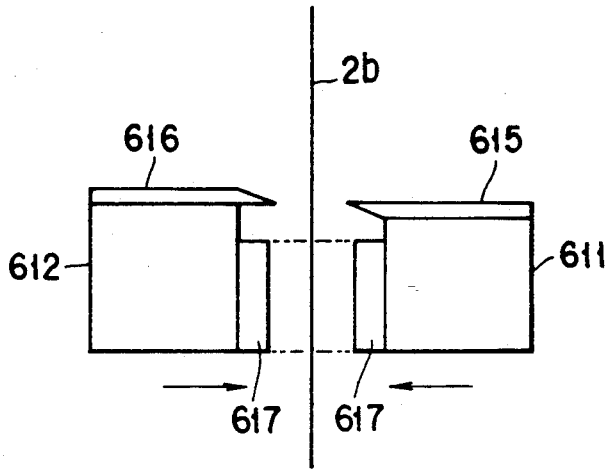
FIG. 16 is a cross-sectional view taken along line 16—16 of FIG. 15.

Referring to FIGS. 14 to 16, the cutting mechanism 112 includes a pair of cutting members 611 and 612 opened and closed by an actuator 610, for cutting the portion of the web 2b between the cutting members 611 and 612. The cutting members 611 and 612 and the actuator 610 are connected to an actuator 614 through an actuator 614 so that they are moved together back and forth.

The cutting members 611 and 612 are fixed by cutting teeth 615 and 616 and holding members 617 disposed below the respective cutting teeth 615 and 616. The holding members 617 are made of elastic material such as synthetic rubber and hold the leading end portion of the cut web 2b therebetween. The cutting members 611 and 612, which are holding the leading end portion of the cut web 2b, are moved forward by the actuator 614 to the position above a container for housing the cut portion of the web 2b. Thereafter, the cutting members 617 are separated from each other to release the leading end portion of the web which was held by the cutting members 617 and let the web fall into the container. Therefore, the leading end portion of the web is securely contained in the container and the leading end portion of the cut web is not caught by any part of the device, preventing any trouble due to this catching of the leading end portion.

This invention is not limited to the above-mentioned embodiment and various modifications are available as long as they are not departed from the scope of this invention.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An automatic web roll changing device for automatically and continuously supplying web rolls to a web supply-connection apparatus having two web rolls replaceably mounted thereon and each comprising a core and a web wound therearound in which said web supply-connection apparatus repeats the steps of drawing out a web from one of said two web rolls and, when said web on said one of said two webs rolls is fully used, drawing out a web from the other one of said two web rolls, and connecting a leading end of said web of said other one of said two web rolls to a trailing end of said one of said two webs, said automatic web roll changing device comprises:

(a) a rotary arm pivoted at a central portion thereof to said web supply-connection apparatus and provided on both ends thereof with two hubs on which web rolls are mounted; and (b) a web roll storage-connection unit provided opposed to said web roll supply-connection apparatus and comprising:

(i) a rotary head rotatable about a vertical axis;

(ii) web roll storing shafts projecting horizontally from said rotary head and each having a distal end coaxially aligned with one of said hubs when said distal end coaxially aligned with one of said hubs when said distal end of the respective one of said web roll storing shafts is directed toward said one of said hubs, each of said web roll storing shafts being provided to mount a plurality of web rolls so that said web rolls are arranged axially of each of said web roll storing shafts and slidable therealong; and (iii) driving means for moving said web rolls mounted on each of said web roll storing shafts toward said distal end thereof.

2. The automatic web changing device according to claim 1, wherein said web roll storing shafts are two in number and are separated by 180° from each other.

3. The automatic web changing device according to claim 1, wherein said hubs of said rotary arm are provided with core rejecting means for rejecting said core, from which said web has been drawn off, from said hub on which said core having said web drawn off is mounted.

* * * * *